US009085999B2

(12) United States Patent
Fujiki et al.

(10) Patent No.: US 9,085,999 B2
(45) Date of Patent: Jul. 21, 2015

(54) PCV VALVES

(71) Applicant: AISAN KOGYO KABUSHIKI KAISHA, Obu-shi, Aichi-ken (JP)

(72) Inventors: Hiroshi Fujiki, Kariya (JP); Takashi Masuda, Toyota (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 16 days.

(21) Appl. No.: 14/074,436

(22) Filed: Nov. 7, 2013

(65) Prior Publication Data

US 2014/0130784 A1 May 15, 2014

(30) Foreign Application Priority Data

Nov. 9, 2012 (JP) ..... 2012-247540

(51) Int. Cl.
*F02M 25/06* (2006.01)
*F01M 13/00* (2006.01)

(52) U.S. Cl.
CPC ..... *F01M 13/0011* (2013.01)

(58) Field of Classification Search
CPC . F01M 13/023; F01M 13/04; F01M 13/0011; F02M 25/06
USPC ..... 123/572–574, 41.86; 137/517, 535
See application file for complete search history.

(56) References Cited

U.S. PATENT DOCUMENTS 3,662,724 A * 5/1972 Ohar et al. ..... 123/574
4,625,703 A * 12/1986 Otto et al. ..... 123/574
5,697,351 A * 12/1997 Schumacher ..... 123/574
2003/0213479 A1* 11/2003 Wade ..... 123/572
2007/0028904 A1* 2/2007 Duprez ..... 123/574
2010/0139634 A1* 6/2010 Wade ..... 123/574
2013/0087222 A1* 4/2013 Fujiki et al. ..... 137/535
2013/0105009 A1* 5/2013 Oda ..... 137/517

FOREIGN PATENT DOCUMENTS

JP 2007-182939 7/2007
JP 2007182939 A * 7/2007

OTHER PUBLICATIONS

Journal of Technical Disclosure 99-6907, Oct. 1, 1999, 2 p.
Japanese Laid-Open Utility Model Publication No. 56-115555, Sep. 4, 1981, 2 p.

* cited by examiner

*Primary Examiner* — Marguerite McMahon
(74) *Attorney, Agent, or Firm* — Conley Rose, P.C.

(57) ABSTRACT

A PCV valve may include a housing and a valve member movable in an axial direction within the housing. A plurality of guide portions may be formed on the valve member, so that the plurality of guide portions slidably contact the monitoring portion of the housing as the valve member moves in the axial direction. When a first part of a tapered portion of the valve member opposes to the monitoring portion, a first contact part of each of the guide portions may contact the monitoring portion. When a second part of the tapered portion having a smaller diameter than the first part opposes to the monitoring portion, a second contact part of each of the guide portions may contact the monitoring portion. The second contact part may be smaller than the first part with respect to a width in a circumferential direction or may have a circumferential contact length smaller than that of the first part.

8 Claims, 6 Drawing Sheets

PCV VALVES

This application claims priority to Japanese patent application serial number 2012-247540, the contents of which are incorporated herein by reference.

BACKGROUND OF THE INVENTION

Field of the Invention

Embodiments of the present invention relate to PCV (Positive Crankcase Ventilation) valves that may be used for blow-by gas refluxing systems of internal combustion engines of vehicles such as automobiles.

A known PCV valve will be described with reference to FIGS. 14 to 17. Referring to FIG. 14, a known PCV valve 140 includes a hollow cylindrical housing 142 having an inlet port 143 and an outlet port 144. A valve member 146 is movably received within the housing 142. The inlet port 143 may communicate within a cylinder head cover of an internal combustion engine (not shown). The outlet port 144 may communicate with a passage part of an intake air passage of the engine at a position on a downstream side of a throttle valve. A monitoring portion 156 having a predetermined diameter and a predetermined axial length is formed by a part of the inner wall of the housing 142 at a position between the inlet port 143 and the outlet port 144.

The valve member 146 has a cylindrical base shaft portion 160 and a tapered portion 162. The tapered portion extends from the base shaft portion 160 and is tapered toward the leading end side. The diameter of the tapered portion 162 increases toward the base shaft portion 160. The tapered portion 162 is inserted into the monitoring portion 156 from the inlet port 143 toward the side of the outlet port 144. A spring 166 is interposed between the housing 142 and the valve member 146 in order to bias the valve member 146 toward the side of the inlet port 143.

When a negative pressure is produced within the intake air passage of the engine, the negative pressure may be introduced into the housing 142 via the outlet port 144. Then, by the action of the negative pressure, the valve member 146 may move toward the side of the outlet port 144 against the biasing force of the spring 166. Therefore, the position of the tapered portion 162 of the valve member 146 may be changed relative to the monitoring portion 156 of the housing 142. In this way, the flow rate of the blow-by gas flowing from the inlet port 143 toward the outlet port 144 after flowing through a clearance (i.e., an opening) between the monitoring portion 156 and the tapered portion 162 may be measured (adjusted). FIGS. 14 and 16 show the state where the valve member 146 is in an operational position for a WOT (Wide-Open Throttle) range of the engine.

Four rib-like guide portions 170 protrude radially outward from the tapered portion 162 and extend in the axial direction so as to slidably contact the monitoring portion 156 of the housing 142 (see FIG. 15). A width 170W of each guide portion 170 lying in a direction intersecting the protruding direction of each guide portion 170 (i.e., a circumferential direction of the valve member 146) is constant throughout the axial length. In this way, the valve member 146 is guided to move in the axial direction through the sliding contact of the guide portions 170 with the monitoring portion 156 of the housing 142 during the axial movement of the valve member 146.

For example, Japanese Laid-Open Patent Publication No. 2007-182939 discloses a PCV valve including a valve member having a plurality of guide portions that can slidably contact a monitoring portion of a housing.

In the case of the known PCV valve described above, the width 170W of each guide portion 170 of the valve member 146 is constant throughout the axial length. Therefore, it may not be possible to satisfy both of two contradicting targets, i.e., an improvement in reduction in wear of slide contact portions of the monitoring portion 156 and the guide portions 170 as well as an increase of the flow rate of the blow-by gas flowing through the opening formed between the monitoring portion 156 of the valve member 146. In FIGS. 14 and 15, the width 170W of each guide portion 170 is set to a relatively small size, while in FIGS. 16 and 17, the width 170W of each guide portion 170 is set to a relatively large size. If the width 170W of each guide portion 170 is set to a relatively small size (as shown in FIGS. 14 and 15), the cross-sectional flow area of the opening between the monitoring portion 156 and the tapered portion 16 may be relatively large, so that it is possible to increase the flow rate of the blow-by gas. However, the contact area of each guide portion 170 contacting the monitoring portion 156 may be reduced, thereby leading to an increase in wear of the slide contact portions. On the other hand, if the width 170W of each guide portion 170 is set to a relatively large size, as shown in FIGS. 16 and 17, the contact area of each guide portion 170 contacting with the monitoring portion 156 may be increased to improve the reduction in the wear of the slide contact portions. However, the cross-sectional flow area of the opening between the monitoring portion 156 and the tapered portion 16 may be relatively small, thereby leading to a decrease in the flow rate of the blow-by gas. In this way, it is difficult to satisfy both of a reduction in wear at the slide contact portions and an increase of the flow rate of the blow-by gas. In particular, there has been a need to increase the flow rate of the blow-by gas in the WOT range of the engine.

Japanese Laid-Open Patent Publication No. 2007-182939 also involves the same problem as the known PCV valve 140.

Therefore, there has been a need in the art for PCV valves that are reduced in wear of the slide contact portions and that can provide an increased flow rate of the blow-by gas.

SUMMARY OF THE INVENTION

In one aspect according to the present teachings, a PCV valve may include a housing and a valve member movable in an axial direction within the housing. A plurality of guide portions may be formed on the valve member, so that the plurality of guide portions slidably contact the monitoring portion of the housing as the valve member moves in the axial direction. When a first part of a tapered portion of the valve member opposes the monitoring portion, a first contact part of each of the guide portions may contact the monitoring portion. When a second part of the tapered portion having a smaller diameter than the first part opposes the monitoring portion, a second contact part of each of the guide portions may contact the monitoring portion. The second contact part may be smaller than the first part with respect to a width in a circumferential direction or may have a circumferential contact length smaller than that of the first part.

DETAILED DESCRIPTION OF THE INVENTION

Figure 1:
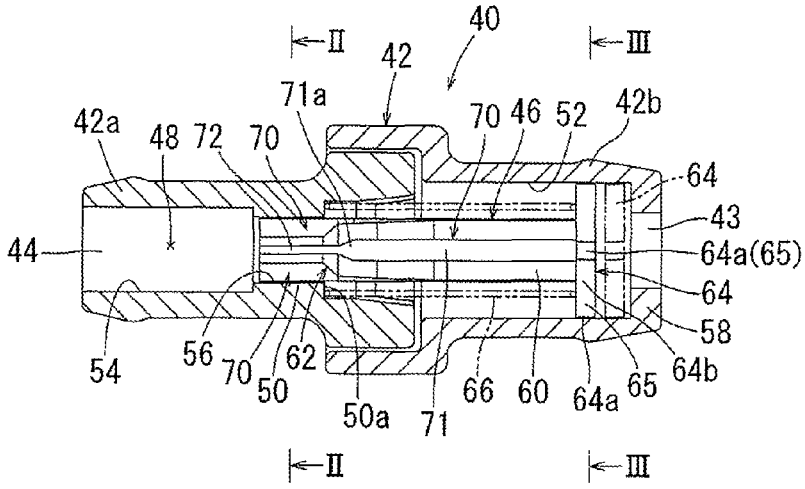
FIG. 1 is a sectional view of a PCV valve along a longitudinal axis according to a first embodiment.

Each of the additional features and teachings disclosed above and below may be utilized separately or in conjunction with other features and teachings to provide improved PCV valves. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

In one embodiment, a PCV valve may include a housing with an inlet port and an outlet port, a valve member movable in an axial direction within the housing, and a monitoring portion formed on an inner wall of the housing and having a substantially circular shape in cross section along a direction perpendicular to the axial direction. The valve member may have a first end portion, a second end portion opposite to the first end portion in the axial direction, and a tapered portion formed throughout an outer circumference of the valve member and positioned between the first end portion and the second end portion, so that the first end portion has a diameter larger than a diameter of the second end portion. As the valve member moves in the axial direction within the housing, the position of the tapered portion may change relative to the monitoring portion, so that a blow-by gas flowing into the housing from the inlet port flows out of the outlet port after the blow-by gas is monitored as the blow-by gas flows through a clearance defined between the monitoring portion and the tapered portion. A plurality of guide portions each configured as a rib may be formed on the valve member. The plurality of guide portions may protrude radially outward from the tapered portion and extend in the axial direction along the valve member, so that the plurality of guide portions can slidably contact the monitoring portion of the housing. Each of the guide portions may have a first part and a second part respectively positioned on the side of the first end portion and the side of the second end portion. The second part may have a width that is smaller than a width of the first part.

With this arrangement, the valve member may be guided to move in the axial direction through the sliding contact of the plurality of guide portions with the monitoring portion of the housing. Therefore, the valve member may be prevented from shifting in the radial direction during axial movement. As a result it is possible to improve the stability in operation of the valve member. In addition, by selecting the width of the second part of each guide portion to be smaller than the width of the first part, it is possible to reduce the wear of the slide contact portions of the guide portions and the monitoring portion when the first parts of the guide portions positioned on the side of the first end portion having a larger diameter than the second end portion of the valve member contact the monitoring portion. On the other hand, it is possible to increase the flow rate of the blow-by gas when the second parts of the guide portions positioned on the side of the second end portion having a smaller diameter than the first end portion of the valve member contact the monitoring portion. In this way, it is possible to reduce the wear of the slide contact portions and to increase the flow rate of the blow-by gas when needed.

Embodiments of the present invention will now be described with reference to the drawings.

<First Embodiment>

A first embodiment will be described with reference to FIGS. 1 to 7. For purpose of explanation, an example of a blow-by gas refluxing system will be described first before the explanation of a PCV valve according to the first embodiment.

Figure 7:
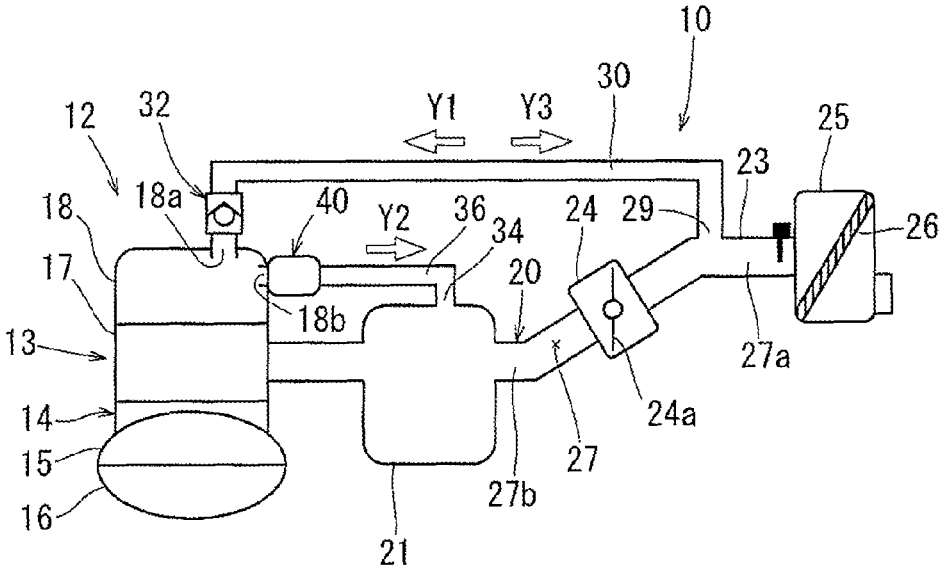
FIG. 7 is a schematic view of a blow-by gas refluxing system.

Referring to FIG. 7, a blow-by gas refluxing system 10 may be configured to introduce a blow-by gas amount from within a crankcase 15 of a cylinder block 14 of an engine body 13 of an internal combustion engine 12 to an intake manifold 20. A combustion chamber (not shown) may leak blow-by gas into the crankcase 15 of the cylinder block 14.

In addition to including the cylinder block 14, the engine body 13 may include an oil pan 15 fastened to the lower surface of the crank case 15, a cylinder head 17 fastened to the upper surface of the cylinder block 14 and a cylinder head cover 18 fastened to the upper surface of the cylinder head 17. The engine body 13 may generate a drive force through intake, compression, expansion and exhaust processes of a known manner. As fuel is combusted within the combustion chamber of the engine body 13, blow-by gas may be produced within the engine body 13 including the inside of the crankcase 15 and the inside of the cylinder head cover 18 communicating with the crankcase 15. In the following explanation, the inside of the cylinder head cover 18, the crankcase 15, etc. within which the blow-by gas may be produced or into which the blow-by gas may flow will be hereinafter collectively called as the inside of the engine body 13.

The cylinder head cover 18 may be provided with a fresh air introduction port 18*a* and/or a blow-by gas extraction port 18*b*. The fresh air introduction port 18*a* may communicate with one end (downstream end) of a fresh air introduction passage 30. The blow-by gas extraction port 18*b* may communicate with one end (upstream end) of a blow-by gas passage 36. The fresh air introduction port 18*a* and/or the blow-by gas extraction port 18*b* may be provided at the crankcase 15 in place of the cylinder head 18.

One end (downstream end) of the intake manifold 20 may communicate with the cylinder head 17. The intake manifold 20 may include a surge tank 21. The other end (upstream end) of the intake manifold 20 may communicate with an air cleaner 25 via a throttle body 24 and an intake pipe 23. The throttle body 24 may include a throttle valve 24*a*. The throttle valve 24*a* may be linked to an accelerator pedal (not shown), so that the throttle valve 24*a* can be opened and closed according to the stepping amount (operation amount) of the accelerator pedal. The air cleaner 25 may receive outside fresh air and may include a filter element 26 disposed therein. The fresh air (intake air) may be introduced from the air cleaner 25 into the combustion chamber of the engine body 13 via the intake pipe 23, throttle body 24 and the intake manifold 20 which together may form a continuous intake passage 27 communicating between the air cleaner 25 and the combustion chamber. In the following explanation, a passage portion of the intake passage 27 on the upstream side of the throttle valve 24*a* will be called an upstream side intake passage portion 27*a*. A passage portion of the intake passage 27 on the downstream side of the throttle valve 24*a* will be called a downstream side intake passage portion 27*b*.

The intake pipe 23 may have a fresh air intake port 29 communicating with the other end (upstream end) of the fresh air introduction passage 30. A backflow preventing valve 32 may be provided in the fresh air introduction passage 30 for allowing the flow of fresh air from the upstream side intake passage portion 27*a* into the crankcase 15 (see arrow Y1 in FIG. 7) and preventing the flow of fresh air in an opposite direction (see arrow Y3 in FIG. 7). The surge tank 21 may have a blow-by gas introduction port 34 communicating with the other end (downstream end) of the blow by gas passage 36. The backflow preventing valve 32 may be provided as the occasion demands.

Next, the operation of the blow-by gas refluxing system 10 will be described. During a low load range and a middle load rage of the engine 12, the throttle valve 24*a* may be positioned at a substantially fully closed position. In this way, a negative pressure may be produced in the intake air passage 27. A negative pressure produced in the downstream sided intake passage portion 27*b* may be larger than that produced in the upstream side intake passage portion 27*a*. In this way, the blow-by gas produced in the engine body 13 may be introduced into the downstream side intake passage portion 27*b* via the blow-by gas passage 36 (see arrow Y2 in FIG. 7). A PCV valve 40 may control or monitor the flow rate of the blow-by gas flowing through the blow-by gas passage 36.

The backflow preventing valve 32 may be opened as the blow-by gas is introduced from within the engine body 13 into the downstream side intake passage portion 27*b* via the blow-by gas passage 36. In this way, the fresh air within the upstream side intake passage portion 27*a* of the intake passage 27 may be introduced into the engine body 13 via the fresh air introduction passage 30 (see arrow Y1 in FIG. 7). The fresh air introduced into the engine body 13 may be further passed to the downstream side intake passage portion 27*b*. It may be passed together with the blow-by gas via the blow-by gas passage 36 (see arrow Y2 in FIG. 7). In this way, the blow-by gas may be scavenged from the inside of the engine body 13.

During a high load range of the engine 12, the degree of opening of the throttle valve 24*a* may be larger than when it is in the low and middle load ranges. In this way, the pressure within the downstream side intake passage portion 27*b* of the intake passage 27 may become closer to the atmospheric pressure. Therefore, the blow-by gas produced in the engine body 13 may be difficult to introduce into the downstream side intake passage portion 27*b* via the fresh air introduction passage 30. For this reason, the pressure within the engine body 13 may become closer to the atmospheric pressure. Hence, the flow rate of the fresh air introduced from the upstream side intake passage portion into the engine body 13 via the fresh air introduction passage 30 may be lowered. The backflow preventing valve 32 may be closed in order to prevent the backflow of the blow-by gas in a direction from within the engine body 13 into the fresh air introduction passage 30.

The PCV valve 40 provided in the blow-by gas passage 36 may control or monitor the flow rate of the blow-by gas according to the difference between the upstream side pressure and the downstream side pressure of the blow-by gas with respect to the PCV valve 40. This pressure difference may be called an intake negative pressure or a boost pressure. Therefore, the blow-by gas may flow into the downstream side intake passage portion 27*b* at a flow rate that is appropriate for the amount of the blow-by gas produced in the engine 12.

The PCV valve 40 will be further described with reference to FIGS. 1 to 6. For the purpose of explanation, the left side as viewed in FIG. 1 will be determined as a front side (leading end side) and the right side as viewed in FIG. 1 will be determined as a rear side (base end side).

As shown in FIG. 1, the PCV valve 40 may generally include a cylindrical tubular housing 42 and a valve member 46 axially movably received within the housing 42. The housing 42 may have an inlet port 43 and an outlet port 44. A gas passage 48 may be defined in the housing 42 to extend in the axial direction (left and right direction as viewed in FIG. 1) of the housing 42. The rear end portion (right end portion as viewed in FIG. 1) of the housing 42 may be connected to the upstream side passage portion of the blow-by gas passage 36 (see FIG. 7). The front end portion (left end portion as viewed in FIG. 1) of the housing 42 may be connected to the downstream side passage portion of the blow-by gas passage 36. Alternatively, the rear end portion of the housing 42 may be connected to the blow-by gas extraction port 18*b* of the cylinder head cover 18 (see FIG. 7).

The housing 42 may include a front housing member 42*a* and a rear housing member 43*b*. If separate members, the front housing member 42*a* and the rear housing member 43*b* may be joined together to form the housing 42. The front and rear housing members 42*a* and 43*b* may be made of resin. A seat portion 50 may be coaxially formed on the inner circumferential wall of the front housing member 42*a* at a substantially middle position with respect to the axial direction so as to protrude radially inward from the circumferential wall in a manner like a flange. An annular stepped surface 50*a* may be formed at the rear end of the seat portion 50. The rear housing member 42*b* may include a cylindrical upstream side passage wall 52 defining a part of the gas passage 48 at a position on the side of the inlet port 43 (right side in FIG. 1). The front housing member 42*a* may include a cylindrical downstream side passage wall 54 defining a part of the gas passage 48 at a position on the front side of the seat portion 50, i.e., a position on the side of the outlet port 44.

A monitoring portion 56 may be formed within the housing 42 at a position between the inlet port 43 and the outlet port 44. The monitoring portion 56 is formed as a cylindrical wall having a predetermined diameter, a predetermined axial length and a circular cross-section. The monitoring portion 56 may be formed by the inner circumferential part of the seat portion 50. A flange-like wall portion 58 may be coaxially formed with the rear end portion of the rear housing member 42*b* so as to protrude radially inward from the rear end of the upstream side passage wall 52. The outlet port 43 may be defined by the circular hole formed in the wall portion 58.

The valve member 46 may include a cylindrical base shaft portion 60 and a tapered portion 62. The tapered portion 62 may extend generally forward from the front end of the base shaft portion 60 and may be tapered toward the front side. A flange 64 may be formed at the rear end (right end in FIG. 1) of the base shaft portion 60 so as to protrude radially outward therefrom. The diameter of the tapered portion 62 may gradually increase in a direction from its leading end toward its base end on the side of the base shaft portion 60. The base end of the tapered portion 62 on the side of the base shaft portion 60 may have a cylindrical shape having the same outer diameter as the base shaft portion 60 so as to generally smoothly continue with the base shaft portion 60. The tapered portion 62 may include a plurality of tapered surfaces and a non-tapered surface. Each of the tapered surfaces may have a diameter increasing toward the base end side. The non-tapered surface may have a constant outer diameter along its axis. It may be possible to provide a plurality of non-tapered surfaces. The number and the tapered angles of the tapered surfaces may be appropriately determined. In addition, the number and the axial lengths of the non-tapered surfaces may be suitably determined.

Figure 4:
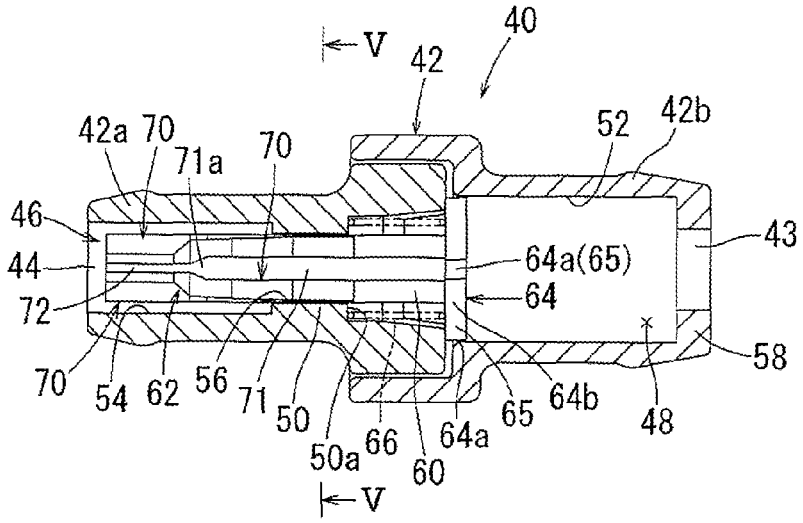
FIG. 4 is a sectional view similar to FIG. 1 but showing the operation in an idling region of an engine.
Figure 5:
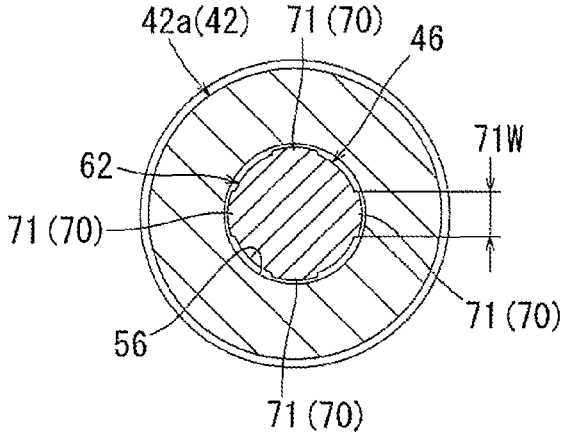
FIG. 5 is a sectional view taken along line V-V in FIG. 4.

The tapered portion 62 of the valve member 36 may be inserted into the monitoring portion 56 of the housing 42 in a direction from the side of the inlet port 43 toward the side of the outlet port 44. As the valve member 46 moves rearward (rightward in FIG. 1), the cross-sectional flow area of the clearance or the opening between the tapered portion 62 and the monitoring portion 56 may increase. On the other hand, as the valve member 46 moves forward (leftward in FIG. 1), the cross-sectional flow area of the clearance or the opening between the tapered portion 62 and the monitoring portion 56 may decrease. The valve member 46 has an operational range R corresponding to a distance between the rear stroke end and the front stroke end of the valve member 46 (see FIG. 6), so that a part of the valve member 46 within the operational range R may be opposed to the monitoring portion 56 in the diametrical direction during the operation of the valve member 46. A leading end side part Ra of the operational range R may be used for a WOT (Wide Open Throttle) range of the engine 12. A base end side part Rc of the operational range R may be used for an idle range of the engine 12. A middle part Rb between the leading end side part Ra and the base end side part Rc may be used for a partial load range of the engine 12. FIG. 1 shows the valve member 46 positioned for the WOT range of the engine 12. FIG. 4 shows the valve member 46 positioned for the idle range of the engine 12.

As shown in FIG. 1, a spring 66 may be disposed within the housing 42 so as to be interposed between the housing 42 and the valve member 46. The spring 66 may be a compression coil spring and may be loosely fitted over a shaft-like portion of the valve member 46. The spring 66 may have one end contacting the seat portion 50 of the housing 42 and have the other end contacting the flange 64 of the valve member 64 opposing the seat portion 50 in the axial direction. In this way, the spring 66 normally biases the valve member 46 toward the side of the inlet port 43.

If the engine 12 (see FIG. 7) is stopped, no negative pressure is produced in the intake passage 27. Therefore, through the biasing force of the spring 66, the valve member 46 of the PCV valve 40 may be brought to the state where the flange 64 is positioned nearer to the wall portion 58 (see two-dot chain lines in FIG. 1). When the engine 12 is started, a negative pressure may be produced in the intake passage 27 and may be introduced into the housing 42 (i.e., the gas passage 48) via the outlet port 44. Therefore, through the action of the negative pressure, the valve member 46 may move toward the outlet port 44 against the biasing force of the spring 66.

During the low load range of the engine 12, the degree of opening of the throttle valve 24*a* may be relatively small, so that a relatively large negative pressure may be produced in the intake passage 27. Therefore, the valve member 46 may move toward the outlet port 44 by the negative pressure. In this way, the base end side part Rc of the operational range R (see FIG. 6) used for the idle range of the engine 12 may be brought to oppose to the monitoring portion 56 in the diametrical direction. In this state, the cross-sectional flow area of the opening formed between the monitoring portion 56 and the tapered portion 62 may be relatively small (see FIG. 5), so that the flow rate of the blow-by gas flowing through the PCV valve 40 may be small.

As the operational range of the engine 12 transfers from the low load range to the middle load range, the degree of opening of the throttle valve 24*a* may increase, so that the negative pressure produced in the intake passage 27 may be reduced. Therefore, the valve member 46 may move toward the inlet port 43 by the biasing force of the spring 66. In this way, the middle part Rb of the operational range R (see FIG. 6) used for the partial load range of the engine 12 may be positioned to oppose the monitoring portion 56. Therefore, the cross-sectional flow area of the opening formed between the monitoring portion 56 and the tapered portion 62 may increase. In this way, the flow rate of the blow-by gas flowing through the PCV valve 40 may increase in comparison with that during the low load range of the engine 12.

As the operational range of the engine 12 transfers from the middle load range to the high load range, the degree of opening of the throttle valve 24*a* may be further increased, so that the negative pressure produced in the intake passage 27 may be further reduced. Therefore, the valve member 46 may move further toward the inlet port 43 by the biasing force of the spring 66. In this way, the leading end side part Ra of the operational range R used for the WOT range of the engine 12 may be positioned to oppose the monitoring portion 56. Therefore, the cross-sectional flow area of the opening formed between the monitoring portion 56 and the tapered portion 62 may further increase. In this way the flow rate of the blow-by gas flowing through the PCV valve 40 may increase in comparison with the flow rate during the middle load range of the engine 12. As described previously, there has been a need to increase the flow rate of the blow-by gas in the WOT region of the engine.

As described above, the tapered portion 62 of the valve member 46 is inserted into the monitoring portion 56 of the housing 42, and the flow rate of the blow-by gas flowing through the opening between the monitoring portion 56 and the tapered portion 62 may change as the position of the tapered portion 62 relative to the monitoring portion 56 in the moving direction of the valve member 46 changes.

Figure 2:
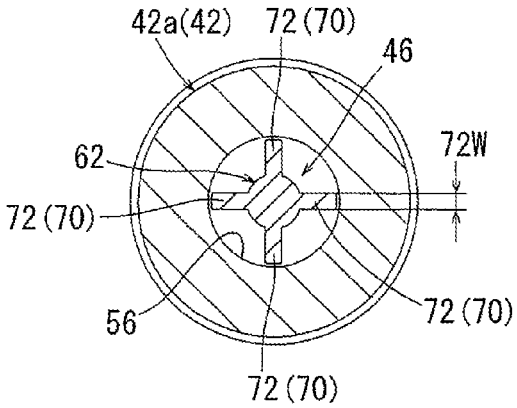
FIG. 2. is a sectional view taken along line II-II in FIG. 1.

Four rib-like guide portions 70 may protrude radially outward from the tapered portion 62 and extend in the axial direction so as to slidably contact the monitoring portion 56 of the housing 42 (see FIGS. 1 and 2). The base end side of the guide portions 70 may be extended to the flange 64 along the outer circumferential surface of the base shaft portion 60. Each of the guide portions 70 may include a broad width part 71, a narrow width part 72 and a width-changing part 71*a*. In this specification, the term "width" used in connection with the guide portions 70 means a width measured in a circumferential direction about the valve member 46 (i.e., a direction perpendicular to the radial direction of the valve member 46 as viewed in FIG. 2). The broad width portion 71 may be positioned at the base end side part of the tapered portion 62. The narrow width part 72 may be positioned at the leading end side part of the tapered portion 62. The width-changing part 71*a* smoothly connects the broad width part 71 and the narrow width part 72 and may have a width gradually decreasing from the side of the broad width part 71 toward the narrow width part 72. The broad width part 71 may have a constant width 71W throughout its length in the axial direction of the valve member 46. Also, the narrow width part 72 may have a constant width 72W throughout its length in the axial direction of the valve member 46. Preferably, the width 71W of the broad width part 71 may be about 2.5 times the width 72W of the narrow width part 72. However, the ratio of the width of the broad width part 71 to the width 72W of the narrow width part 72 may not be limited but rather be suitably adjusted.

Figure 6:
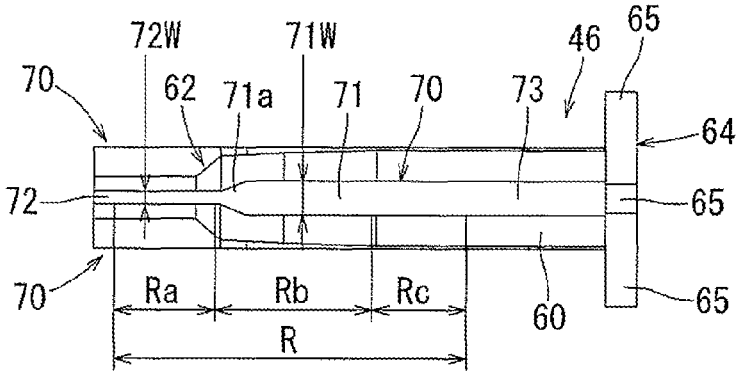
FIG. 6 is a side view of a valve member.

As shown in FIG. 6, the axial length of the broad width part 71 and the axial length of the width-changing part 71*a* may be determined such that broad width part 71 and the width-changing part 71*a* extend along the length of a range including the middle range Rb for the partial load range and the base end side range Rc for the idle range. Each of the guide portions 70 may further include an extension part 73 extending from the broad width part 71 to the flange 64 along the outer circumferential surface of the base shaft portion 60. The extension part 73 may have a same width as the width 71W of the broad width part 71. The axial length of the narrow width part 72 may be determined such that the narrow width part 72 extends along the length of the leading end side range Ra (see FIG. 6) for the WOT range and extends further forwardly from the leading end side range Ra by a given distance. The four guide portions 70 are spaced equally from each other in the circumferential direction of the valve member 46 (see FIGS. 2 and 5).

Figure 3:
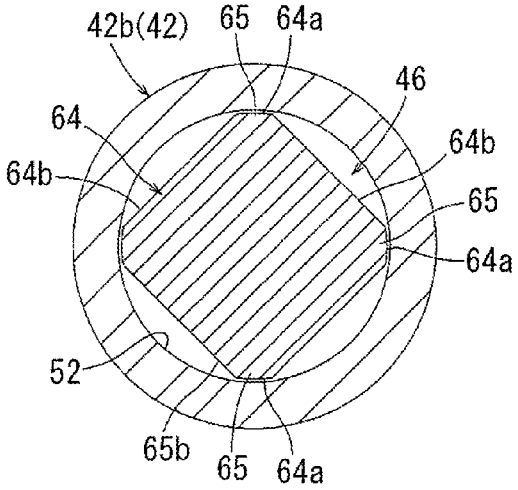
FIG. 3 is a sectional view taken along line III-III in FIG. 1.

The flange 64 of the valve member 46 may have a substantially circular disk-shape (see FIG. 3). Four slide contact surfaces 64*a* may be formed on the outer circumferential surface of the flange 64 so as to be spaced equally from each other in the circumferential direction. In addition, four cut-out surfaces 64*b* may be formed on the outer circumferential surface of the flange 64 so as to be spaced equally from each other in the circumferential direction. Each cut-out surface 64*b* is positioned between two adjacent slide contact surfaces 64*a*. In other words, the cut-out surfaces 64*b* may be arranged alternately with the slide contact surfaces 64*a* in the circumferential direction. The slide contact surfaces 64*a* may slidably contact the upstream side passage wall 52. In this way, four auxiliary guide portions 65 each having the slide contact surface 64*a* may be formed on the outer peripheral portion of the flange 64 so as to be spaced equally from each other in the circumferential direction. Openings may be formed between the upstream side passage wall 52 and the cut-out surfaces 64*b* of the flange 64 to allow passage of the blow-by gas.

With the PCV valve 40 configured as described above, as the valve member 46 moves axially within the housing 42, the four guide portions 70 (more specifically, their radially outer end surfaces) slidably contact the monitoring portion 56 of the housing 42. In addition, the four auxiliary guide portions 65 (more specifically, their slide contact surfaces 64*a*) may slidably contact the upstream side passage wall 52 of the housing 42. In this way, the valve member 46 may be guided in the axial direction by the four guide portions 70 and the four auxiliary guide portions 65. Hence, it is possible to assuredly prevent the valve member 46 from shifting movement in the radial direction. As a result, it is possible to improve stability in terms of the operation of the valve member 46.

In addition, by determining the width 72W of the leading end side part of each of the guide portions 70 (i.e., the width of the narrow width part 72) to be smaller than the width 71W of the base end side part (i.e., the width of the broad width part 71) (see FIG. 6), it is possible to reduce the wear of the slide contact portions between the monitoring portion 56 and the guide portions 70. Thus, when the base end side part (having the broad width 71W) of each guide portion 70 contacts the monitoring portion 56 (see FIGS. 4 and 5), the wear of these slide contact portions may be small. The contact of the base end side part (having the broad width 71W) of each guide portion 70 with the monitoring portion 56 (see FIGS. 4 and 5) may occur when a part of the broad width part 71 corresponding to the base end side part Rc of the operational range R used for the idle range of the engine 12 opposes the monitoring portion 56 in the diametrical direction. For the idle range of the engine 12, it is not necessary to increase the flow rate of the blow-by gas flowing though the opening formed between the monitoring portion 56 and the tapered portion 62.

The leading end side part (having the narrow width 72W) of each guide portion 70 may contact the monitoring portion 56 when the narrow width part 72 corresponding to the leading end side part Ra of the operational range R (see FIG. 6) used for the WOT range of the engine 12 opposes the monitoring portion 56 in the diametrical direction. For the WOT range of the engine 12, it is desirous to increase the flow rate of the blow-by gas flowing though the opening formed between the monitoring portion 56 and the tapered portion 62. Because the leading end side part having the narrow width 72W of each guide portion 70 may contact the monitoring portion 56 in this case, it is possible to increase the flow rate of the blow-by gas (see FIGS. 1 and 2).

In this way, it is possible to achieve both a decrease in the wear of the slide contact portions and an increase of the flow rate of the blow-by gas.

Second to seventh embodiments will now be described with reference to FIGS. 8 to 13. These embodiments are modifications of the first embodiment. Therefore, in FIGS. 8 to 13, like members are given the same reference numerals as the first embodiment and the description of these members will not be repeated.

<Second Embodiment>

Figure 8:
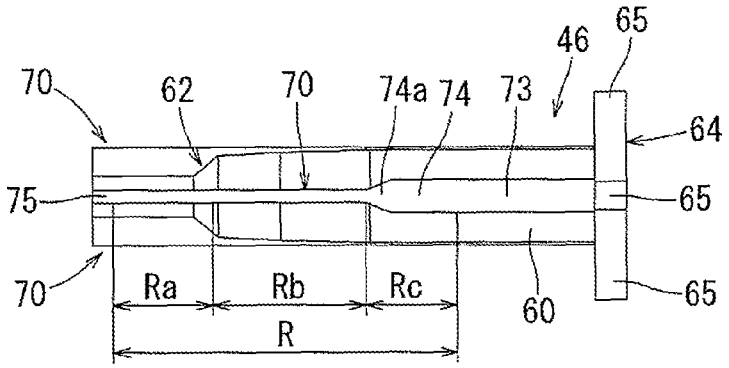
FIG. 8 is a side view of a valve member of a PCV valve according to a second embodiment.

The second embodiment will now be described with reference to FIG. 8. The second embodiment is different from the first embodiment in one way in that the guide portions 70 of the valve member 46 are modified.

According to the second embodiment, each of the guide portions 70 of the valve member 46 has a broad width part 74, a narrow width part 75 and a width-changing part 74*a*. The axial length of the broad width part 74 is determined such that the broad width part 74 extends along the length of the base end part Rc (see FIG. 6) used for the idle range of the engine 12. On the other hand, the axial length of the narrow width part 75 is determined such that the narrow width part 75 extends along the length of a range including the leading end side range Ra (see FIG. 6) for the WOT range and the middle range Rb for the partial load range and extends further forward beyond this range by a given distance. The broad width part 74 is connected to the narrow width part 75 via the width-changing part 74*a* that has a width gradually increasing from the side of the narrow width part 75 toward the broad width part 74.

<Third Embodiment>

Figure 9:
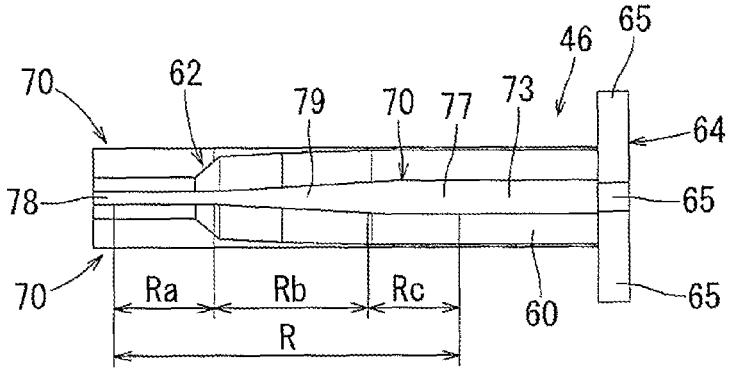
FIG. 9 is a side of a valve member of a PCV valve according to a third embodiment.

The third embodiment will now be described with reference to FIG. 9. The third embodiment is at least different from the second embodiment in that the guide portions 70 of the valve member 46 are modified.

According to the third embodiment, each of the guide portions 70 of the valve member 46 has a broad width part 77, a narrow width part 78 and a width-changing part 79. The axial length of the broad width part 77 is determined such that the broad width part 77 extends along the length of the base end part Rc (see FIG. 6) used for the idle range of the engine 12. The axial length of the narrow width part 78 is determined such that the narrow width part 78 extends along the length of the leading end side range Ra (see FIG. 6) for the WOT range and further forwardly beyond this range Ra by a given distance. The broad width part 77 is connected to the narrow width part 78 via the width-changing part 79 that has a width gradually increasing from the side of the narrow width part 78 toward the broad width part 77. The axial length of the width-changing part 79 is determined such that the width-changing part 79 extends along the length of the middle rage Rb used for the partial load range.

<Fourth Embodiment>

Figure 10:
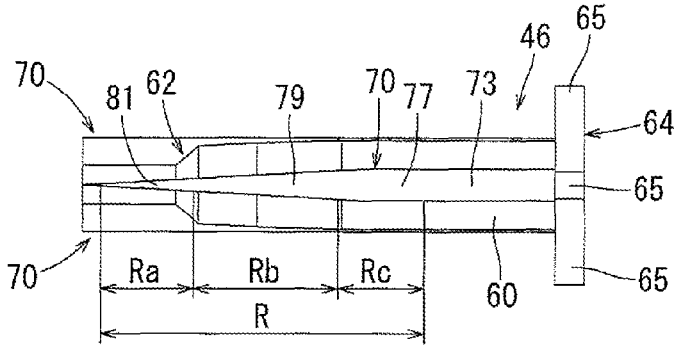
FIG. 10 is a side view of a valve member of a PCV valve according to a fourth embodiment.

The fourth embodiment will now be described with reference to FIG. 10. The fourth embodiment is different from the third embodiment in that the guide portions 70 of the valve member 46 are modified. According to this embodiment, the narrow width part 78 of each guide portion 70 is replaced with a second width-changing part 81 formed in series with the width-changing part 79 and having a width gradually increasing toward the width-changing part 79.

<Fifth Embodiment>

Figure 11:
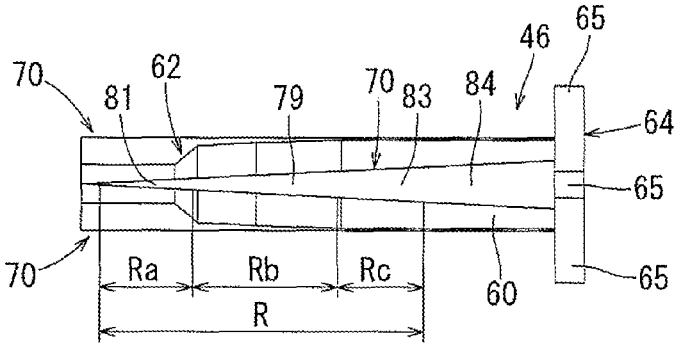
FIG. 11 is a side view of a valve member of a PCV valve according to a fifth embodiment.

The fifth embodiment will now be described with reference to FIG. 11. The fifth embodiment is at least different from the fourth embodiment in that the guide portions 70 of the valve member 46 are modified. According to this embodiment, the broad width part 77 of each guide portion 70 is replaced with a third width-changing part 83 formed in series with the width-changing part 79. In addition, the extension part 73 is replaced with a fourth width-changing part 84 extending in series with the third width-changing part 83. In this way, the width of each guide portion 70 gradually increases from its leading end to its base end.

<Sixth Embodiment>

Figure 12:
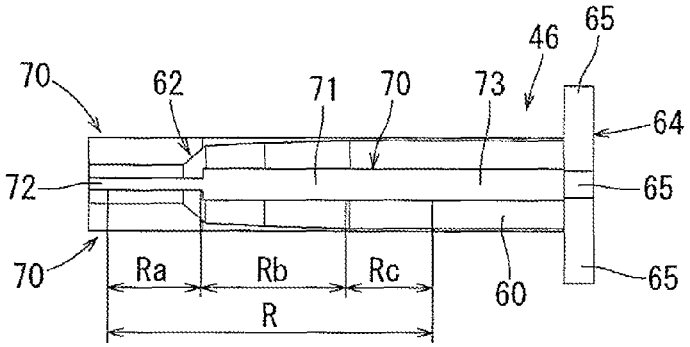
FIG. 12 is a side view of a valve member of a PCV valve according to a sixth embodiment.

The sixth embodiment will now be described with reference to FIG. 12. The sixth embodiment is at least different from the first embodiment in that the guide portions 70 of the valve member 46 are modified. According to this embodiment, the width-changing part 71*a* of each guide portion 70 is omitted, so that the broad width part 71 and the narrow width part 72 are connected to each other via a stepped part.

<Seventh Embodiment>

Figure 13:
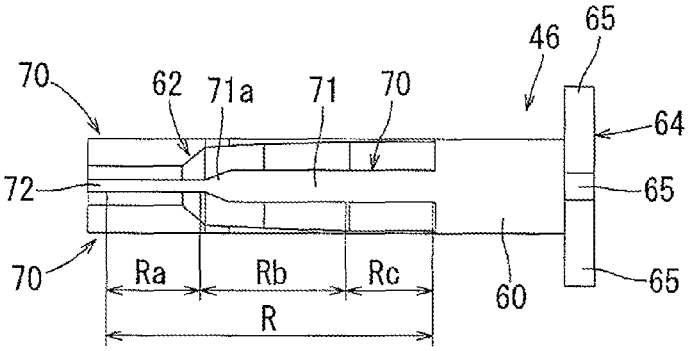
FIG. 13 is a side view of a valve member of a PCV valve according to a seventh embodiment.
Figure 14:
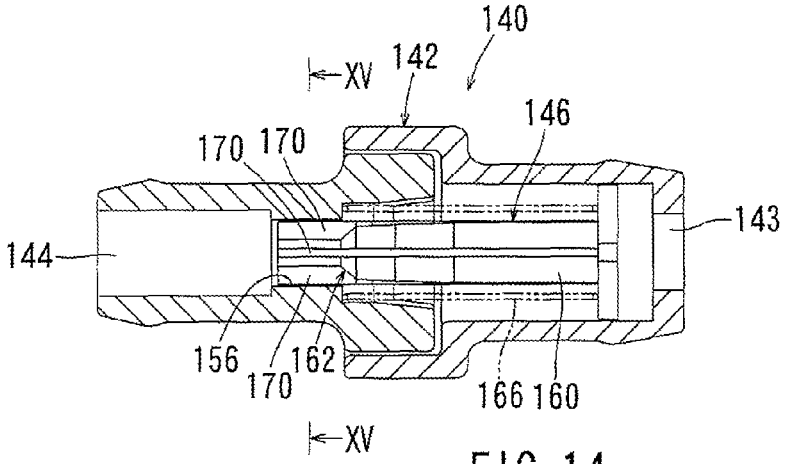
FIG. 14 PRIOR ART
FIG. 14 is a sectional view of a PCV valve along a longitudinal axis of a known PCV valve.
Figure 15:
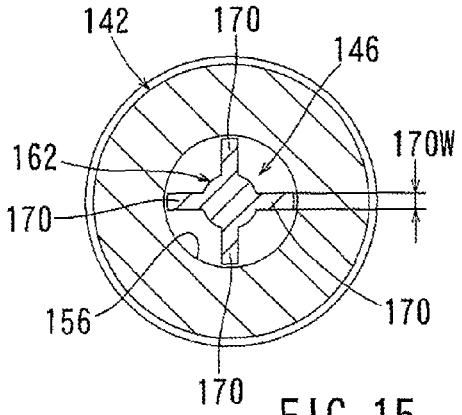
FIG. 15 PRIOR ART
FIG. 15 is a sectional view taken along line XV-XV in FIG. 14.
Figure 16:
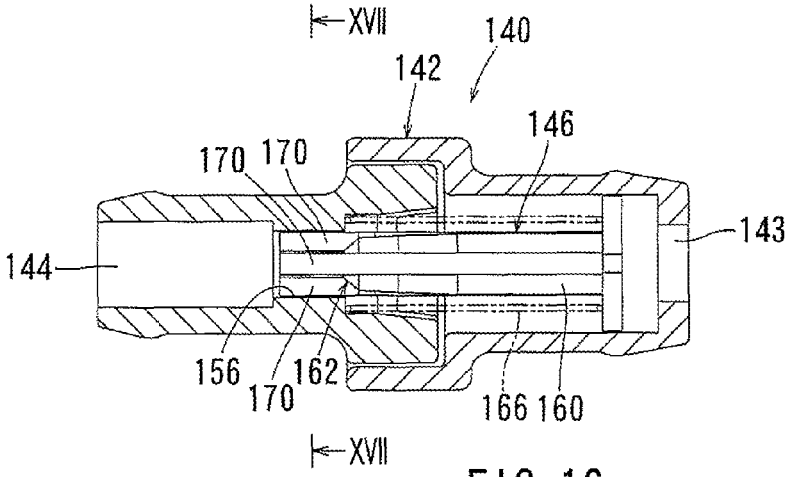
FIG. 16 PRIOR ART
FIG. 16 is a sectional view similar to FIG. 14 with a width of each guide portion of the PCV valve increased than that shown in FIG. 14.
Figure 17:
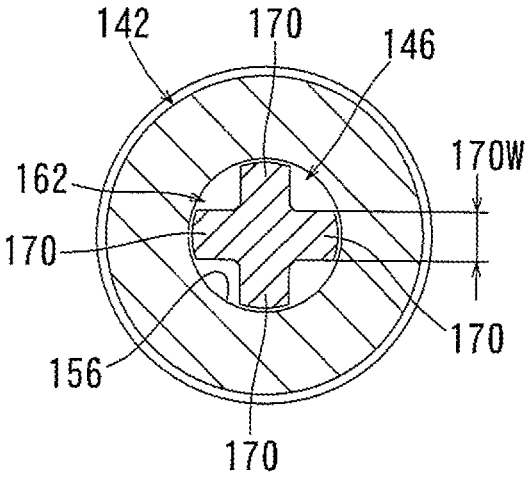
FIG. 17 PRIOR ART
FIG. 17 is a sectional view taken along line XVII-XVII in FIG. 16.

The seventh embodiment will now be described with reference to FIG. 13. The seventh embodiment is at least different from the first embodiment in that the guide portions 70 of the valve member 46 are modified. The extension part 73 extending rearwardly from the broad width part 71 of each guide portion 70 is preferably not opposed to the monitoring portion 56 in the diametrical direction during the operation of the valve member 46. Therefore, in this embodiment, the extension part 73 is omitted.

<Other Possible Modifications>

The above embodiments may be modified in various ways. For example, it may be possible to combine features from two or more of the above embodiments. The number of the guide portions 70 may not be limited to four but may be one, two, three or five or more. Similarly, the number of the auxiliary guide portions 65 may not be limited to four but may be one, two, three or five or more. It may be also possible that the number of the guide portions 70 is different from the number of the auxiliary guide portions 65. The auxiliary guide portions 65 may be omitted in some cases. The housing 42 and/or the valve member 46 may be made of any other material than resin and may be made, for example, of metal.

What is claimed is:

1. A PCV valve comprising:

a housing having an inlet port and an outlet port;

a valve member movable in an axial direction within the housing; and a monitoring portion formed on an inner wall of the housing and having a substantially circular shape in cross section along a direction perpendicular to the axial direction, wherein:

the valve member has a first end portion, a second end portion opposite to the first end portion in the axial direction, and a tapered portion positioned between the first end portion and the second end portion, so that the first end portion has a diameter larger than a diameter of the second end portion;

as the valve member moves in the axial direction within the housing, the position of the tapered portion changes relative to the monitoring portion, so that blow-by gas flowing into the housing from the inlet port flows out of the outlet port after the blow-by gas is monitored as the blow-by gas flows through a clearance defined between the monitoring portion and the tapered portion;

a plurality of guide portions each configured as a rib are formed on the valve member to protrude radially outward from the tapered portion and to extend in the axial direction along the valve member, so that the plurality of guide portions slidably contact the monitoring portion of the housing;

each of the guide portions has a first part and a second part respectively positioned on the side of the first end portion and the side of the second end portion; and the second part has a width smaller than a width of the first part.

2. The PCV valve according to claim 1, wherein:

the width of the first part is constant along the length of the first part;

the width of the second part is constant along the length of the second part;

each of the guide portions further includes a width-changing part positioned between the first part and second part; and the width of the width-changing part gradually decreases from the side of the first part toward the side of the second part.

3. The PCV valve according to claim 1, wherein:

the blow-by gas is introduced into the inlet port of the housing from an engine, the first part of each of the guide portions contacts the monitoring portion during an idle range of the engine; and the second part of each of the guide portions contacts the monitoring portion during a WOT range of the engine.

4. The PCV valve according to claim 3, wherein:

each of the guide portions further includes a third part positioned between the first part and the second part; and the third part contacts the monitoring portion during a partial load range of the engine.

5. A PCV valve comprising:

a housing having an inlet port and an outlet port;

a valve member movable in an axial direction within the housing and having a tapered portion;

wherein the tapered portion includes a first part having a first diameter and a second part having a second diameter smaller than the first diameter;

a monitoring portion formed on an inner wall of the housing, wherein when the valve member is positioned at a first position in the axial direction, the first part of the tapered portion opposes the monitoring portion in a radial direction, wherein when the valve member is positioned at a second position in the axial direction, the second part of the tapered portion opposes the monitoring portion in a radial direction;

a plurality of guide portions each protruding radially outward from the valve member and having a length in the axial direction of the valve member, so that the plurality of guide portions slidably contact the monitoring portion of the housing as the valve member moves in the axial direction;

wherein each of the guide portions has a first contact part extending from the first part of the tapered portion and a second contact part extending from the second part of the tapered portion;

wherein the first contact part has a first width in a circumferential direction of the valve member;

wherein the second contact part has a second width in the circumferential direction of the valve member; and wherein the second width is smaller than the first width.

6. The PCV valve according to claim 5, wherein:

when the valve member is positioned at the first position in the axial direction, a first open area is defined by the first part of the tapered portion, the monitoring portion and the guide portions;

when the valve member is positioned at the second position, a second open area is defined by the second part of the tapered portion, the monitoring portion and the guide portions; and the second open area is larger than the first open area.

7. A PCV valve comprising:

a housing having an inlet port and an outlet port;

a valve member movable in an axial direction within the housing and having a tapered portion;

wherein the tapered portion includes a first part having a first diameter and a second part having a second diameter smaller than the first diameter;

a monitoring portion formed on an inner wall of the housing, wherein when the valve member is positioned at a first position in the axial direction, the first part of the tapered portion opposes the monitoring portion in a radial direction, wherein when the valve member is positioned at a second position in the axial direction, the second part of the tapered portion opposes the monitoring portion in a radial direction;

a plurality of guide portions each protruding radially outward from the valve member and having a length in the axial direction of the valve member, so that the plurality of guide portions slidably contact the monitoring portion of the housing as the valve member moves in the axial direction;

wherein each of the guide portions has a first contact part including a first width and extending from the first part of the tapered portion and a second contact part including a second width and extending from the second part of the tapered portion, the first width being different from the second width;

wherein the first contact part has a first contact surface configured to contact the monitoring portion along a first length in a circumferential direction of the valve member;

wherein the second contact part has a second contact surface configured to contact the monitoring portion along a second length in the circumferential direction; and wherein the second length is smaller than the first length.

8. The PCV valve according to claim 7, wherein:

when the valve member is positioned at the first position in the axial direction, a first open area is defined by the first part of the tapered portion, the monitoring portion and the guide portions;

when the valve member is positioned at the second position, a second open area is defined by the second part of the tapered portion, the monitoring portion and the guide portions; and the second open area is larger than the first open area.

* * * * *